United States Patent [19]

Nicks et al.

[11] 4,161,181

[45] Jul. 17, 1979

[54] SMOKE FILTERING ASHTRAYS

[76] Inventors: Robert W. Nicks, 2047 Cambridge, Cardiff-By-The-Sea, Calif. 92007; Larry King, 1660 S. Amphlett Blvd., San Mateo, Calif. 94402

[21] Appl. No.: 778,119

[22] Filed: Mar. 16, 1977

[51] Int. Cl.[2] ..... A24F 19/00; A24F 19/10

[52] U.S. Cl. ..... 131/231; 55/385 G

[58] Field of Search ..... 131/238, 235 R, 231, 131/263, 264; 55/385 G

[56] References Cited

U.S. PATENT DOCUMENTS

| | | | |
|---|---|---|---|
| 2,747,101 | 5/1956 | Hammond | 131/238 |
| 2,788,085 | 4/1957 | Waller | 55/385 G |
| 3,194,246 | 7/1965 | Mantchev | 131/263 |
| 3,229,008 | 1/1966 | Harrington et al. | 131/264 |
| 3,370,592 | 2/1968 | Schultz et al. | 131/263 |
| 3,675,662 | 7/1972 | Askins | 131/235 R |
| 4,043,776 | 8/1977 | Orel | 131/238 |

FOREIGN PATENT DOCUMENTS

| | | | |
|---|---|---|---|
| 908185 | 10/1962 | United Kingdom | 131/266 |

*Primary Examiner*—Robert W. Michell
*Assistant Examiner*—V. Millin
*Attorney, Agent, or Firm*—Arthur F. Holz

[57] ABSTRACT

An ashtray open at the top for supporting burning cigarettes and collecting cigarette butts is mounted over a small battery driven DC motor which drives a closed face centrifical fan which, when activated, draws air and smoke through a replaceable cartridge filter element mounted between the fan and ashtray, expelling cleansed air at the bottom.

19 Claims, 9 Drawing Figures

SMOKE FILTERING ASHTRAYS

BACKGROUND OF THE INVENTION

The invention described herein addresses the growing public perceptions of the harmful effects of tobacco smoke emitted into a room from burning cigarettes and cigars. Reports from the Surgeon General's office of the United States have made reference not only to the harmful effects of smoke directly inhaled by the smoker on his cardiovascular system, but to harmful effects from inhalation of smoke mixed with atmospheric air by both smokers and nonsmokers within a room. Approximately 50% of the smoke introduced into the room atmosphere results from smoke directly rising from the burning cigarette or cigar during intervals between puffs, independent of inhalation and exhalation by the smoker. The present invention seeks to capture that portion of the smoke rising directly from the cigarette or cigar by encouraging the smoker to place the burning cigarette or cigar in the ashtray receptacle between puffs, drawing the smoke through a multiple filtering device by means of a fan and expelling the filtered cleansed air into the room atmosphere substantially free of irritating particles, gases and odors.

The configuration of the device disclosed and described is particularly well-suited to efficient capture and filtering of the smoke from burning cigarettes and cigars, is convenient to use and thus encourages frequent and ready use by the smoker and is adaptable to other embodiments suitable for specific placements but utilizing the same principles enumerated.

DESCRIPTION OF THE PRIOR ART

The field of smoke removing ashtrays is populated with two principal devices. The earlier group is typified by U.S. Pat. No. 2,029,192, disclosing a large device accomodating a powerful bulky motor required to draw the smoke through a lengthy passage. The size of the unit not only causes it to be noisy and inefficient in operation but prevents its convenient placement. The present invention is compact, designed to stand on a tabletop or any convenient location in order to encourage frequent use by the smoker. Further, the development of miniature DC motors of efficient and quiet operation enable the unit to be compact and the air passage short and direct, in turn decreasing the air flow requirements on the fan and the power output required of the motor. The later goup is typified by U.S. Pat. Nos. 3,797,205 and 3,807,148, involving contrived over head smoke collecting devices, circuitious and unecessarily lengthy passages through which smoke and air must travel and requiring inconvenient placement of the lighted cigarette by the smoker tending to discourage its frequent use. The present invention incorporates an open design, maximizing convenience, and a simplified direct minimum passage length for smoke and air to travel, while providing at the same time a large multiple filter interposed through the majority of the passage for efficient cleansing effect.

SUMMARY OF THE INVENTION

The specific embodiment of the invention described herein incorporates an ashtray receptacle of a solid cast material containing depressions for resting the cigar or cigarette and a circular depression containing a metal plate with perforations through which ashes and butts may drop into a receiving cup below the ashtray itself.

The ashtray is mounted on a housing supporting the ashtray vertically over the receiving cup, filter assembly, fan and motor assembly, in order that air is drawn downward directly from the burning tip of the cigarette through the filter and expelled by the fan as cleansed air out the bottom of the housing. A cylindricaly inner-housing is provided supporting a replaceable multiple element filter constructed in the shape of a vertically thick donut. The outer vertical surface of the donut-shaped filter fits snugly against the wall of the filter housing and the inner surface of the cavity in the donut-shaped filter fits snugly against a housing containing a small, battery driven DC motor. A supporting plate at the bottom of the filter contains perforations through which the filtered smoke is drawn from the filter by a fan mounted horizontally directly beneath the supporting plate. The fan is attached by a hub to the shaft of the DC motor and is of a fixed blade, closed face design which covers and creates a partial vacuum over the perforated surface of the filter supporting plate. The cleansed air drawn from the filter is forced radially outward by the rotating fan blades and expelled from the bottom of the unit through the space created by four rubber tipped legs which support the unit about ¼ inch from the table surface.

Mountings for 1 ½ volt batteries are provided inside the outer housing and are connected to the DC motor via a two position touch switch extended through the upper cast ashtray plate. A additional switch and resistor may be incorporated into the circuit to vary the fan speed, low for cigarettes or high for larger cigars. A recharging jack is also provided for refreshing the batteries or for operation from AC current through a rectifying transformer.

The replaceable donut-shaped filter element may be composed of several layers of differing materials which are separately effective to remove distinct components of the tobacco smoke. Among these separate elements are an expanded aluminum wire mesh sprayed with an absorptive oil coating, a layer of activated fine charcoal granules, a layer of bicarbonate of soda, a layer of cotton or polyester batting, and a broad mesh polyethelyne layer for electrostatic filtering effect.

DETAILED DESCRIPTION OF THE PREFERRED EMBODIMENT

Figure 1:
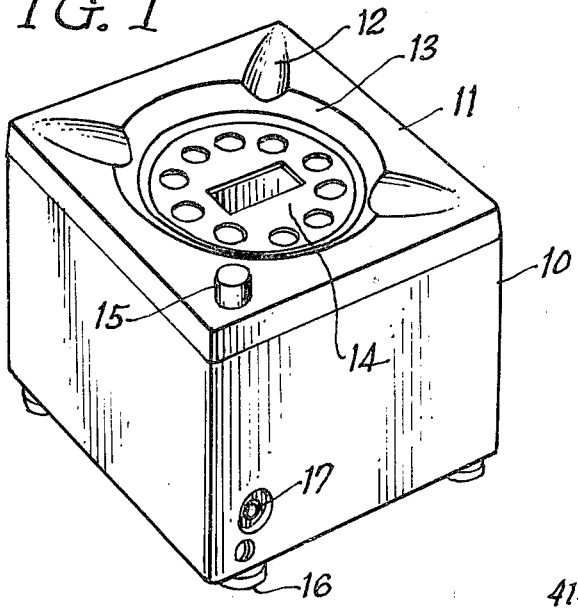
FIG. 1 is a perspective view of the assembled ashtray filtering unit.

Referring to the drawings, FIG. 1 illustrates the external appearance of the smoke filtering ashtray. the outer housing (10) supports a resistant ashtray of cast epoxy material (11); the casting provides depressions

(12) for supporting a burning cigarette and rimmed circular depression (13) to which the burning end of the cigarette extends. A perforated metal plate (14) separates the burning cigarette from the internal components of the device through a plurality of circular holes provided in the metal plate and allows cigarette butts to drop through a rectangular hole in the plate to a receiving butt cup below. An extension button (15) for activating a two position switch internally contained extends through the top plate. A recharging jack receptacle (17) is accessable through the housing. Four rubber tipped legs (16) support the entire unit at a distance of about 1/4" above the table surface.

Figure 2:
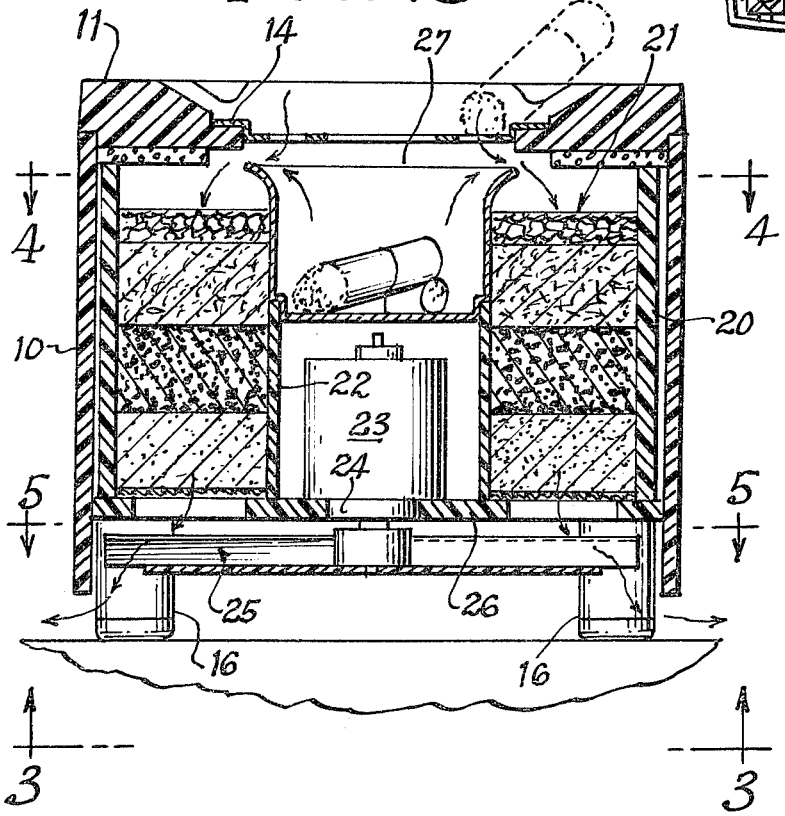
FIG. 2 is a vertical cross section of the assembled unit displaying the flow of smoke and air from the cigarette through the filtering unit and expelled at the bottom.

Referring to FIG. 2, a vertical cross section illustrates further features and operation of the device. A lighted cigarette is shown in dashed outline resting in a depression in the cast ashtray top (11), its lighted end supported on the perforated metal plate (14). Ashes and smoke from the burning cigarette may pass through the perforations in plate 14 directly into the rimmed butt cup (27), shown also containing extinguished butts for later removal. The smoke is drawn directly from the lighted end of the cigarette either passing onto the top element of the filter cartridge (21) or into the butt cup and drawn over the inclined rim of the cup onto the filter surface, the smoke path being illustrated by small arrows. The filter is constructed of layers of various elements later described and supported by a cylindrical inner wall (20) and a cylindrical wall (22) which also forms a compartment for the miniature DC motor (23). The walls 20 and 22 contain the filter cartridge snugly so that smoke must pass through the filtering elements and will not pass unifiltered between the filter and the outer wall. The motor compartment and the filter cavity are enclosed at the bottom by a perforated plate (26) through which the motor shaft is connected by a hub (24) to the fan blade (25). The rotating fan blade creates a partial vacuum at the lower surface of the perforated supporting plate (26) drawing smoke downward through the filter elements, drawing the cleansed air onto the fan blades and expelling the cleansed air radially out of the device through the space between the elevated housing and the table surface.

Figure 3:
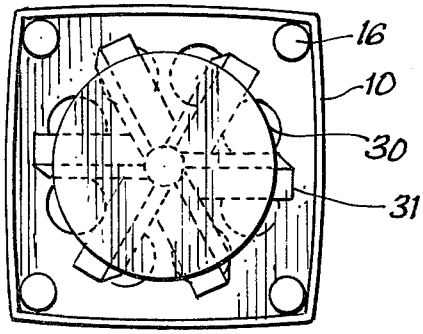
FIG. 3 is a view of the bottom portion of the assembled unit.
Figure 4:
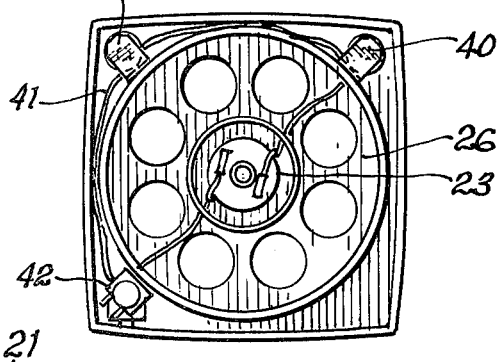
FIG. 4 is a view from the top of the housing with the ashtray top, filter cartridge, and butt cup removed.
Figure 5:
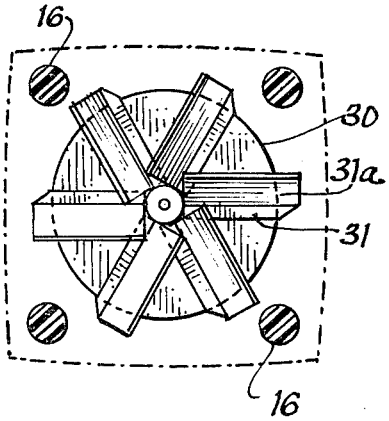
FIG. 5 is a horizontal cross section of the unit revealing an upper view of the fan blade assembly.

FIG. 3 illustrates the configuration of the fan blade from the bottom view of the unit. A circular plate (30) encloses the bottom face of the fan and supports the individual fan blades (31) which rotate over the perforated area of the supporting plate (26) as shown in FIG. 4, through which the cleansed air is drawn from the filter cavity. FIG. 5 further illustrates from a top view of the fan assembly that each fan blade (31) is attached to circular plate (30) at its narrower portion and that an inclined portion (31) of each fan blade serves as the leading edge of the fan blades, rotating in a counter clockwise direction as viewed in FIG. 5. The broader portion of the blade is inclined upward at approximately 30° taking a "bite" of the air and pushing it radially outward beneath the inclined portion of the fan blade, expelling the air at the outer end of the blade.

Referring back to FIG. 4, the electrical components of the device as shown including two battery brackets (40) mounted on the filter cavity wall, connected in series by a wiring harness (41), through a double throw switch (42) and to the terminals of the miniature DC motor (23).

Figure 6:
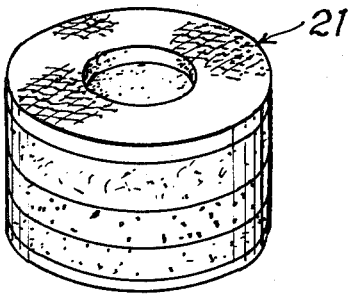
FIG. 6 is a perspective view of the donut-shaped filter cartridge.

FIG. 6 illustrates the layered construction of the filter cartridge unit (21) in a thick donut-shape designed to fit exactly into the cavity provided by the unit housing. When the ashtray top and the butt cup are removed the filter unit will freely slide into its cavity and may easily be replaced at intervals when saturated by contaminants from tobacco smoke. The entire cartridge is bound together by walls constructed of outer and inner tubes of cardboard or plastic packaging material, open at the top and bottom.

Figure 7:
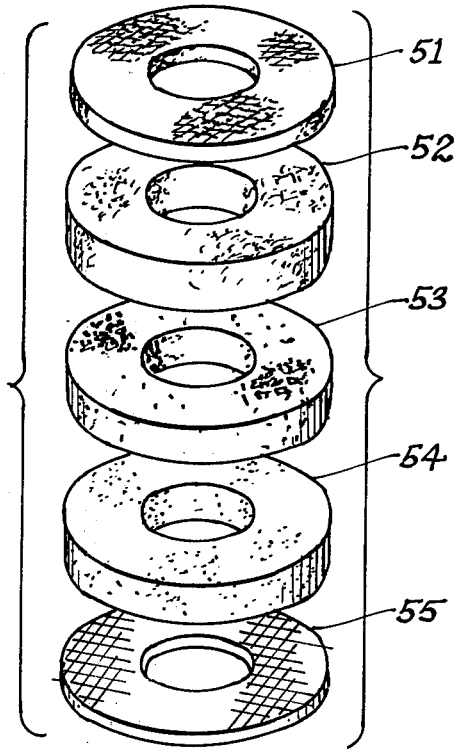
FIG. 7 is an expanded view of the layered components of the filter cartridge.

FIG. 7 shows in exploded view that the filter cartridges composed of distinct layers of various filtering elements. Although the composition of each element layer may vary and their order may be rearranged, the order and composition of the layers as shown in FIG. 7 provides a filtering effect experimentally determined to trap a majority of the various particulate and gaseous noxious substances in the tobacco smoke, resulting in an odor free air discharge. The individual filter element layers thus have not only a separate filtering effect on distinct components of the smoke, but a cascaded cumulative filtering effect as well.

Element 51 is an expanded aluminum mesh which is sprayed with a filter coat type of oil in common usage in circulating air system filters, which have the effect of trapping particulate aspects of the tobacco smoke and holding them in suspension in the oil. Element 52 provides further mechanical particulate filtering by means of a layer of cotton or polyester batting, and serves to contain as a spacer the loose granular or powdered construction of other layers of the filter. Element 53 comprises such a loose granular layer, providing an absorptive filter of fine activated charcoal granules, attracting and adhereing gaseous elements of the tobacco smoke. An alternative or additional granular absorptive filter may be composed of a substance such as potassium permangenate. Filter element 54 provides further absorption of odors and gases through a layer of common sodium bicarbonate, supported on either side of the layer and separated from adjacent layers by a thin disc of cotton or polyester batting of the same type as provided in element 52. Finally, element 55 provides a final filtering effect of fine particulates which may have escaped the preceding filter elements by attracting and holding the particulates electrostatically rather than mechanically. The effect is obtained by providing a loose mesh of polyethelyne which self generates an electrostatic field created by friction of the air flow through the material. Surface charges are generated which efficiently attract and trap subvisible (10 micron and smaller) particles.

Figure 8:
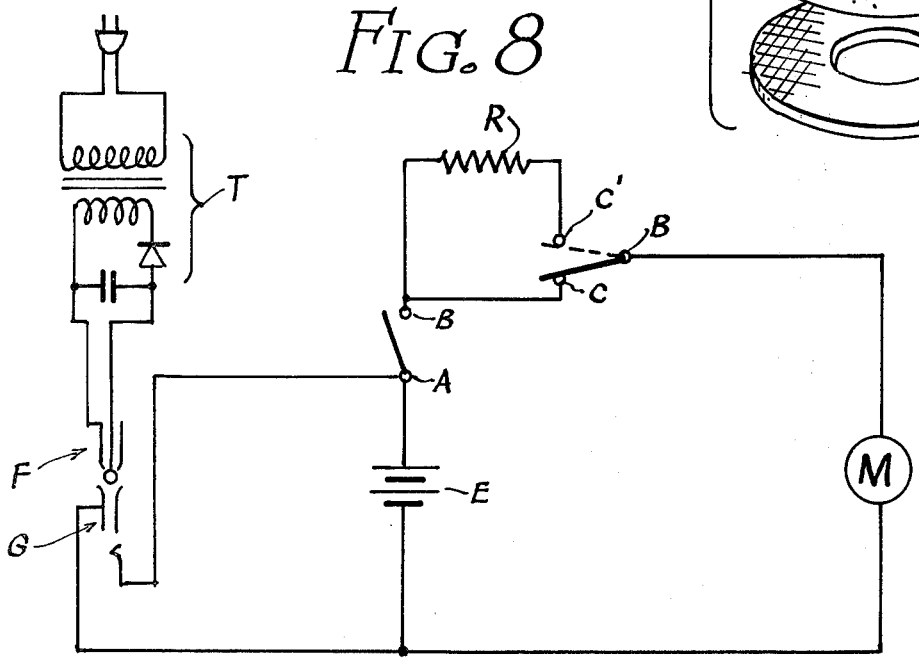
FIG. 8 is a circuit diagram of the electrical components of the device.
Figure 9:
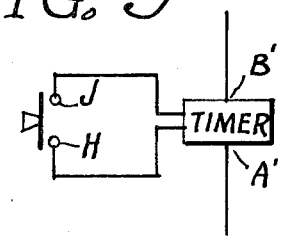
FIG. 9 is a diagram of an optional timing circuit which may be inserted into the diagram of FIG. 8 in lieu of mechanical switch A-B.

FIG. 8 discloses a simple circuit diagram providing a voltage source E representing the rechargeable nickel-cadmium batteries applied to the DC motor M through switch A-B. An additional switch may be provided which when in position C-B, applies full battery voltage to the motor and which when in position C'-B, reduces the voltage applied to motor M and thus the motor speed by attenuating the voltage is proportion to resistor R. A standard wall plug type miniature transformer rectifier T provides low voltage DC current when jack F is inserted into jack receptacle G, enabling direct operation of the switched motor circuit from the stepped down rectified 110 AC current or for recharging the battery source E to full potential when switch A-B is open. FIG. 9 details an alternative switch means incorporating a self contained electronic timer the leads of which A'-B' may be connected in place of switch A-B as shown on FIG. 8. The timer is activated by a spring loaded touch switch across J-H placing a momentary charge on a capacitive discharge circuit of appropriate constant to maintain conductance of a diode for a period of time roughly corresponding to the burning time of a cigarette.

Thus the invention described accomplishes the following objectives:

A. Convenience of use and thus increased effectiveness provided by the open compact design which may be placed unobtrusively on any table top surface.

B. Efficiency of smoke capture is provided drawing smoke directly from the burning cigarette tip without opportunity for the smoke to be mixed with ambiant air or disturbed by and disbursed before capture by currents in the ambiant air.

C. A minimized passage length for travel of smoke and air is provided, decreasing power requirements to produce an adequate pressure differential between the top and bottom of the filter element and thus minimizing the power required of the fan and motor assembly.

D. Further convenience is provided by an easily replaceable cartridge filter element and a cigarette butt receptacle easily removed and emptied.

E. Filtering of varying components of the tobacco smoke is enabled by multiple filter elements placed throughout the majority of smoke travel.

F. Cleansed air is discharged and disbursed into the atmosphere around the entire lower perimeter of the unit.

We claim:

1. A combination ashtray and smoke filtering device comprising:

a. A molded ashtray top piece vertically supported by a housing body, said ashtray having depressions for supporting lighted cigarettes and a plurality of perforations through which smoke, ashes and butts may pass;

b. Cupped retaining means for collection of ashes and butts placed vertically below the supported cigarette;

c. A removable cartridge filter placed vertically beneath the ashtray top;

d. Inner and outer vertical walls which closely contain the filter cartridge and enclose the path of smoke and air, the inner wall enclosing a space concentric with the cartridge for containing motor drive means;

e. A horizontal plate enclosing the filter and motor compartments formed by said inner and outer walls, and containing a plurality of perforations for air passage;

f. Direct current electric motor means, the shaft of the motor vertically aligned and connected to the hub of fan means;

g. Horizontally aligned centrifugal fan means parallel to and closely placed to said perforated supporting plate, the central hub of the fan connected to the motor shaft;

h. Exit vents adjacent to the otuer perimeter of said centrifugal fan, wherby said fan driven by said motor will draw air and smoke through the pathway thus defined from the ashtray top through the filter enclosed by the vertical walls through the perforated horizontal plate, and discharge the filtered air at the exit vents;

i. Voltage source providing D-C current to said motor means;

j. Switch means to interrupt the flow of D-C current to said motor means.

2. The device of claim 1, wherein the molded ashtray top piece further contains a concentric metal plate containing a plurality of perforations.

3. The plate of claim 2, wherein a rectangular perforation is further provided to allow passage of cigarette butts.

4. The device of claim 1, wherein the removable cartridge filter is a cylinder having a concentric cylindrical cavity.

5. The cylindrical filter of claim 4 wherein the cylinder is composed of distinct layers of a plurality of filtering substances, bound together by an outer package cylinder.

6. The cylindrical filter of claim 5 wherein one of the layered substances is expanded metal mesh sprayed with an filter-oil coating.

7. The cylindrical filter of claim 5 wherein one of the layered elements is cotton or polyester batting.

8. The cylindrical filter of claim 5 wherein one of the layered elements is activated charcoal granules.

9. The cylindrical filter of claim 5 wherein one of the layered elements is sodium bicarbonate.

10. The cylindrical filter of claim 5 wherein one of the layered elements is polyethylene mesh.

11. the device of claim 1 wherein the cupped butt-retaining means is a cylindrical metal cup having an inclined lip around the open upper perimeter disposed for retention of ashes passing through the perforations of the ashtray top piece.

12. The device of claim 1 wherein the fan means is a closed face cetrifugal fan having a plurality of radial blades mounted on a flat plate.

13. The fan of claim 12 wherein a portion of the blades is inclined at about 30° from the plane of the flat mounting plate.

14. The device of claim 1 further comprising a plurality of legs supporting the housing above an external surface allowing air exhaust passage between the housing and the external surface.

15. The device of claim 1 wherein the exit vents are composed of the exhaust passage space maintained by the legs of claim 14.

16. The device of claim 1 further comprising battery mounts attached to said housing body together with wire connections to the terminals of said motor means.

17. The device of claim 1 further comprising a branch resistive circuit which may be inserted in the battery motor circuit by further switch means.

18. The device of claim 1 wherein a jack receptacle is connected in parallel with said battery means for accepting external power.

19. The device of claim 1 wherein the switch means includes an electronic timing circuit and momentary spring-loaded activating switch means.

* * * * *